US009922590B2

(12) United States Patent
Wang et al.

(10) Patent No.: US 9,922,590 B2
(45) Date of Patent: Mar. 20, 2018

(54) DRIVING APPARATUS AND METHOD FOR DRIVING DISPLAY PANEL THEREOF

(71) Applicant: HIMAX TECHNOLOGIES LIMITED, Tainan (TW)

(72) Inventors: Jia-Hui Wang, Tainan (TW); Chuan-Chien Hsu, Tainan (TW); Hung-Yu Huang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 401 days.

(21) Appl. No.: 14/871,318

(22) Filed: Sep. 30, 2015

(65) Prior Publication Data

US 2017/0092184 A1 Mar. 30, 2017

(51) Int. Cl.

| | |
|---|---|
| ***G09G 5/00*** | (2006.01) |
| ***G09G 3/20*** | (2006.01) |
| ***G09G 3/36*** | (2006.01) |

(52) U.S. Cl.

CPC ..... *G09G 3/2092* (2013.01); *G09G 3/2007* (2013.01); *G09G 3/3688* (2013.01); *G09G 2300/08* (2013.01); *G09G 2310/027* (2013.01); *G09G 2310/0245* (2013.01); *G09G 2310/0291* (2013.01); *G09G 2310/08* (2013.01); *G09G 2330/021* (2013.01); *G09G 2330/028* (2013.01)

(58) Field of Classification Search

CPC ..... G09G 3/038; G09G 3/20; G09G 3/32; G09G 3/36; G09G 5/00; G09G 5/10; G09G 5/18

See application file for complete search history.

(56) References Cited

U.S. PATENT DOCUMENTS

| | | | | |
|---|---|---|---|---|
| 8,026,889 | B2 | 9/2011 | Tazuke | |
| 2006/0238478 | A1* | 10/2006 | Lin | G09G 3/20 345/98 |
| 2012/0013587 | A1* | 1/2012 | Yen | G09G 3/3688 345/211 |
| 2016/0035306 | A1* | 2/2016 | Park | G09G 3/3696 345/212 |

FOREIGN PATENT DOCUMENTS

| | | |
|---|---|---|
| TW | 201506873 | 2/2015 |
| TW | 201535966 | 9/2015 |

OTHER PUBLICATIONS

"Office Action of Taiwan Counterpart Application", dated Oct. 7, 2016, p. 1-p. 5.

* cited by examiner

*Primary Examiner* — Ilana Spar
*Assistant Examiner* — Nguyen H Truong
(74) *Attorney, Agent, or Firm* — J.C. Patents

(57) ABSTRACT

A driving apparatus and a method for driving a display panel thereof are provided. The driving apparatus includes an output buffer, a switch, an adjusting circuit, a digital-to-analog converter and a code detecting unit. The output buffer provides an output voltage to a load according to a static current determining a speed of the output voltage reaching a target voltage for driving the load. The switch is coupled between the output buffer and the load in series, and is turned on or off according to a control signal. The code detecting unit detects an input code. The adjusting circuit determines whether the input code varies when the control signal is enabled, and disables a high driving ratio signal when the input code does not vary when the control signal is enabled. An enabling period of the high driving ratio signal is different from an enabling period of the control signal.

20 Claims, 6 Drawing Sheets

DRIVING APPARATUS AND METHOD FOR DRIVING DISPLAY PANEL THEREOF

BACKGROUND OF THE INVENTION

1. Field of the Invention

The present invention generally relates to a driving technology, in particular, to a driving apparatus and a method for driving a display panel thereof.

2. Description of Related Art

Generally, a driving apparatus may include a digital-to-analog converter (DAC) for converting a digital signal into an analog driving signal, and an output buffer (e.g. an operational amplifier) for enhancing a driving ability of the driving signal. Referring to FIG. 1, FIG. 1 is a schematic diagram of an output stage of a driving apparatus. The output stage of the driving apparatus includes an output buffer 110 and a switch 120. The output buffer 110 may be is an operational amplifier, which may receive an input voltage VI and provide an output voltage VO to a load 130 through the switch 120. The load 130 may be an image output device or an audio output device, which may be illustrated as a capacitor in FIG. 1.

Specifically, the switch 120 is controlled by a control signal TP, so as to determine whether the output voltage VO is transmitted to the load 130 for driving. Referring to FIG. 2, FIG. 2 is a timing diagram of signals of the driving apparatus in FIG. 1. When the DAC executes a digital-to-analog conversion to convert an input code into the input voltage VI, the control signal TP may be enabled to a high voltage level (i.e. an enabling period P1) to turn off the switch 120, so as to disconnect the output buffer 110 and the load 130, which may avoid error signals to be transmitted to the load 130.

In addition, during the switch 120 being turned off (i.e. during the enabling period P1 of the control signal TP), the output buffer 110 may further increase a static current by a high driving ratio signal HDR, in order to make the output voltage VO to reach a target voltage for driving the load 130. Generally, an enabling period P2 of the high driving ratio signal HDR may be the same as the enable period P1 of the control signal TP. However, although the static current provided by the high driving ratio signal HDR may enhance the driving ability of the output buffer 110, more power may be consumed, which may be worse for large-scale image outputting devices.

SUMMARY OF THE INVENTION

Accordingly, the present invention is directed to a driving apparatus and a method for driving a display panel thereof, which may adaptively adjust the static current of the output buffer, and therefore may reduce power consumption effectively.

The invention provides a driving apparatus, which is adapted to drive a display panel. The driving apparatus includes an output buffer, a switch, an adjusting circuit, a digital-to-analog converter and a code detecting unit. The output buffer is used for receiving an input voltage and providing an output voltage to a load according to a static current, where the static current determines a speed of the output voltage reaching a target voltage for driving the load. The switch is coupled between the output buffer and the load in series, where the switch is turned on or off according to a control signal. The adjusting circuit is coupled to the output buffer. The digital-to-analog converter is coupled to the output buffer. The digital-to-analog converter is used for receiving an input code and converting the input code into the input voltage. The code detecting unit is coupled to the digital-to-analog converter and the adjusting circuit. The code detecting unit is used for detecting the input code. The adjusting circuit determines whether the input code varies when the control signal is enabled, and when the input code does not vary when the control signal is enabled, the adjusting circuit disables a high driving ratio signal. An enabling period of the high driving ratio signal is different from an enabling period of the control signal.

In an embodiment of the invention, the adjusting circuit obtains the enabling period of the control signal, sets the high driving ratio signal according to the enabling period of the control signal and a preset time, and adjusts the static current of the output buffer according to the high driving ratio signal.

In an embodiment of the invention, the preset time is determined according to the speed of the output voltage reaching the target voltage.

In an embodiment of the invention, the adjusting circuit sets the enabling period of the high driving ratio signal according to a comparison of the enabling period of the control signal and the preset time.

In an embodiment of the invention, the adjusting circuit determines whether the enabling period of the control signal is longer than the preset time, when the enabling period of the control signal is longer than the preset time, the adjusting circuit decreases the enabling period of the high driving ratio signal than the enabling period of the control signal, and when the enabling period of the control signal is not longer than the preset time, the adjusting circuit increases the enabling period of the high driving ratio signal than the enabling period of the control signal.

In an embodiment of the invention, the adjusting circuit adjusts a current driving ratio for setting the static current of the output buffer when the high driving ratio signal is enabled according to a comparison of the enabling period of the control signal and the preset time.

In an embodiment of the invention, the adjusting circuit determines whether the enabling period of the control signal is longer than the preset time, when the enabling period of the control signal is longer than the preset time, the adjusting circuit decreases the current driving ratio, and when the enabling period of the control signal is not longer than the preset time, the adjusting circuit increases the current driving ratio.

In an embodiment of the invention, when the enabling period of the control signal is shorter than the preset time, and when the input code varies when the control signal is enabled, the adjusting circuit obtains a gray-scale difference according to the varied input code, and increases the enabling period of the high driving ratio signal according to the gray-scale difference.

In an embodiment of the invention, an enable time point of the control signal and an enable time point of the high driving ratio signal are the same.

In an embodiment of the invention, the output buffer is an operational amplifier, and the adjusting circuit includes a bias generating unit and a switching circuit, where the switching circuit is coupled to the bias generating unit. The bias generating unit includes a plurality of transistors coupled in parallel between a power supply voltage and a current source. The switching circuit is used for turning on at least one of the transistors according to the enabling period of the control signal. The bias generating unit generates a bias voltage to disable or enable the high driving ratio signal according to a number of the turned-on transistors.

The invention provides a method for driving a display panel, which is adapted to a driving apparatus including an output buffer a switch, a digital-to-analog converter and a code detecting unit. The output buffer receives an input voltage and provides an output voltage to a load according to a static current, where the static current determines a speed of the output voltage reaching a target voltage for driving the load. The digital-to-analog converter receives an input code and converts the input code into the input voltage. The method for driving the display panel includes following steps. The input code is detected by the code detecting unit. Whether the input code varies when a control signal is enabled is determined, where the switch coupled between the output buffer and the load in series is turned on or off according to the control signal. When the input code does not vary when the control signal is enabled, a high driving ratio signal is disabled, where an enabling period of the high driving ratio signal is different from an enabling period of the control signal.

In an embodiment of the invention, the method for driving the display panel further includes obtaining the enabling period of the control signal, setting the high driving ratio signal according to the enabling period of the control signal and a preset time, and adjusting the static current of the output buffer according to the high driving ratio signal.

In an embodiment of the invention, the preset time is determined according to the speed of the output voltage reaching the target voltage.

In an embodiment of the invention, the step of setting the high driving ratio signal according to the enabling period of the control signal and the preset time includes setting the enabling period of the high driving ratio signal according to a comparison of the enabling period of the control signal and the preset time.

In an embodiment of the invention, the step of setting the enabling period of the high driving ratio signal according to the comparison of the enabling period of the control signal and the preset time includes determining whether the enabling period of the control signal is longer than the preset time, when the enabling period of the control signal is longer than the preset time, decreasing the enabling period of the high driving ratio signal than the enabling period of the control signal, and when the enabling period of the control signal is not longer than the preset time, increasing the enabling period of the high driving ratio signal than the enabling period of the control signal.

In an embodiment of the invention, the step of setting the high driving ratio signal according to the enabling period of the control signal and the preset time includes adjusting a current driving ratio for setting the static current of the output buffer when the high driving ratio signal is enabled according to the comparison of the enabling period of the control signal and the preset time.

In an embodiment of the invention, the step of setting the current driving ratio for adjusting the static current of the output buffer when the high driving ratio signal is enabled according to the comparison of the enabling period of the control signal and the preset time includes determining whether the enabling period of the control signal is longer than the preset time, when the enabling period of the control signal is longer than the preset time, decreasing the current driving ratio, and when the enabling period of the control signal is not longer than the preset time, increasing the current driving ratio.

In an embodiment of the invention, the method for driving the display panel further includes when the enabling period of the control signal is shorter than the preset time, and when the input code varies when the control signal is enabled, obtaining a gray-scale difference according to the varied input code, and increases the enabling period of the high driving ratio signal according to the gray-scale difference.

In an embodiment of the invention, an enable time point of the control signal and an enable time point of the high driving ratio signal are the same.

In an embodiment of the invention, the output buffer is an operational amplifier. The step of setting a high driving ratio signal according to the enabling period of the control signal and a preset time includes turning on at least one of a plurality of transistors according to the enabling period of the control signal, and generating a bias voltage to disable or enable the high driving ratio signal according to a number of the turned-on transistors.

Based on the above, the driving apparatus and the method for driving a display panel thereof disclosed by the embodiments of the invention may adaptively adjust the enabling period of the high driving ratio signal to be different from the enabling period of the control signal. Besides, when the input code does not vary when the control signal is enabled, the high driving ratio signal may be disabled. Thus, the power consumption caused by the static current of the output buffer may be effectively reduced.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
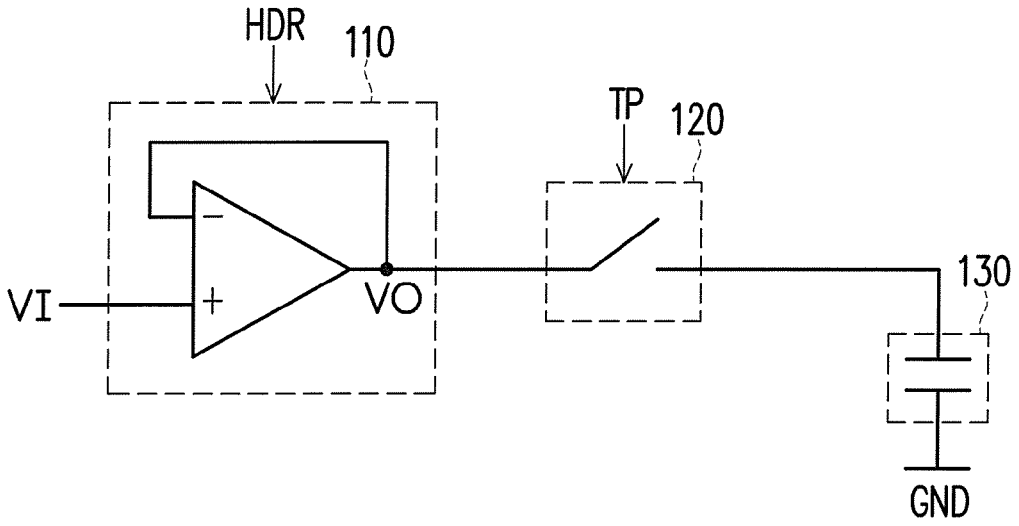
FIG. 1 is a schematic diagram of an output stage of a driving apparatus.
Figure 2:
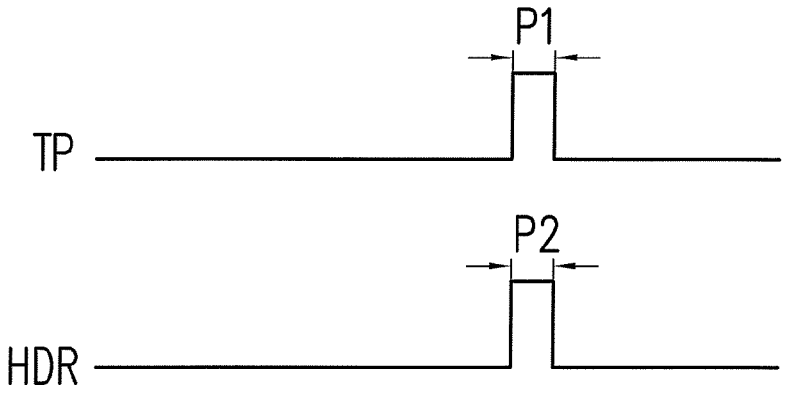
FIG. 2 is a timing diagram of signals of the driving apparatus in FIG. 1.

Reference will now be made in detail to the present preferred embodiments of the invention, examples of which are illustrated in the accompanying drawings. Wherever possible, the same reference numbers are used in the drawings and the description to refer to the same or like parts.

In a driving apparatus, when a digital-to-analog converter (DAC) executes a digital-to-analog conversion, an output buffer may be disconnected with a load (e.g. a display panel). During the disconnected period, the output buffer may receive a fixed current, which allows an output voltage of the output buffer to reach a target voltage for driving the load, but may sharply increase a static current of the output buffer. In order to take into account both driving ability and power consumption of the output buffer during the disconnected period with the load, the embodiments of the invention may set a high driving ratio signal according to the disconnected period (e.g. an enabling period of a control signal for disconnecting the output buffer and the load) and a preset time corresponding to a speed of the output voltage reaching the target voltage, such that the enabling period of the high driving ratio signal and the enabling period of the control signal may be different, and hence the static current of the output buffer may be adaptively adjusted according to the high driving ratio signal. Thus, the power consumption may be effectively reduced.

Figure 3A:
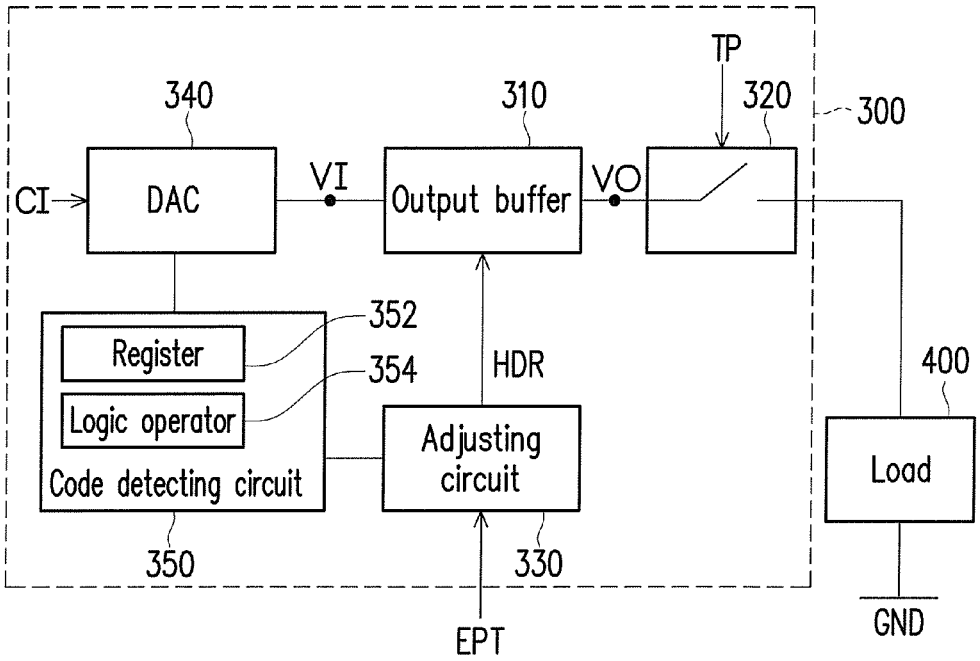
FIG. 3A is a block diagram illustrating a driving apparatus according to an embodiment of the invention.

FIG. 3A is a block diagram illustrating a driving apparatus according to an embodiment of the invention. Referring to FIG. 3A, a driving apparatus 300 may be adapted to drive a load 400, where the load 400 may be, for example, a display panel (e.g. a liquid crystal display panel) or a speaker. The driving apparatus 300 includes an output buffer 310, a switch circuit 320, an adjusting circuit 330, a digital-to-analog converter (DAC) 340 and a code detecting circuit 350, where the functionalities thereof are given as follows.

The output buffer 310 may be, for example, implemented as a negative-feedback operational amplifier. The output buffer 310 may receive an input voltage VI, and provide an output voltage VO to the load 400 according to a static current. The static current, e.g. the current value thereof, may determine a speed of the output voltage VO reaching a target voltage for driving the load 400. Particularly, when the output voltage VO and the target voltage are the same, it may be indicated that the load 400 may be correctly driven by the driving apparatus 300.

The switch 320 may be coupled between the output buffer 310 and the load 400 in series. The switch 320 may be turned on or off according to a control signal TP. In the present embodiment, the switch 330 may be turned off when the control signal TP is enabled (e.g. a high voltage level), while may be turned on when the control signal TP is disabled (e.g. a low voltage level).

The adjusting circuit 330 may be coupled to the output buffer 310. In the present embodiment, the adjusting circuit 330 may set a high driving ratio signal HDR according to an enabling period EPT of the control signal TP and a preset time, so as to adjust the static current of the output buffer 310 according to the high driving ratio signal HDR.

In the present embodiment, the adjusting circuit 330 may include a bias generating unit and a switching unit, where the switching unit may be coupled to the bias generating unit. The bias generating unit may include a plurality of transistors coupled in parallel between a power supply voltage and a current source. The switching circuit may turn on at least one of the transistors according to the enabling period EPT of the control signal TP, such that the bias generating unit may generate a bias voltage to disable or enable the high driving ratio signal HDR according to a number of the turned-on transistors, so as to adjust the static current of the output buffer 310.

Figure 3B:
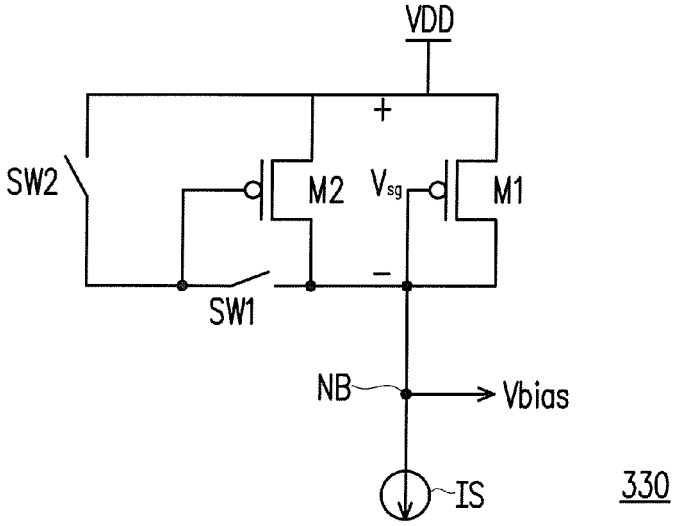
FIG. 3B is a circuit diagram illustrating an adjusting circuit according to the embodiment of FIG. 3A.

An exemplary embodiment of the adjusting circuit 330 may be provided as follows. FIG. 3B is a circuit diagram illustrating the adjusting circuit 330 according to the embodiment of FIG. 3A. Referring to FIG. 3B, in the adjusting circuit 330, the bias generating unit includes two transistors M1 and M2 coupled to each other in parallel. The transistor M1 and M2 respectively include a control terminal, a first terminal and a second terminal. The first terminal of the transistor M1 and the first terminal of the transistor M2 are commonly coupled to a power supply voltage VDD, and the second terminal of transistor M1 and the second terminal of transistor M2 are commonly coupled to a current source IS and a bias terminal of the output buffer 310 through a node NB.

In addition, the switching circuit of the adjusting circuit 330 in FIG. 3B includes two switches SW1 and SW2. The switch SW1 is coupled between the control terminal and the second terminal of the transistor M2, and the switch SW2 is coupled between the control terminal of the transistor M2 and the power supply voltage VDD. In the present embodiment, the switch SW2 may be controlled by the control signal TP, and the switch SW1 may be controlled by a complementary signal of the control signal TP. Therefore, during the enabling period EPT of the control signal TP, the switch SW1 may be turned on for connecting the control terminal and the second terminal of the transistor M2, and the switch SW2 may be turned off for disconnecting the control terminal and the power supply voltage VDD. Therefore, both the transistors M1 and M2 may be turned on.

On the other hand, when the control signal TP is disabled, the switch SW1 may be turned off for disconnecting the control terminal and the second terminal of the transistor M2, and the switch SW2 may be turned on for connecting the control terminal of the transistor M2 and the power supply voltage VDD. In this situation, only the transistor M1 may be turned on.

More specifically, for the case that the switch SW1 is turned on and the switch SW2 is turned off, both the transistors M1 and M2 may be turned on, such that the bias generating unit may correspond to a resistance value lower than each turned-on resistance value of the turned-on transistors M1 and M2 (since the transistors M1 and M2 are coupled to each other in parallel). Since the current source IS may provide a current with a fixed current value, a voltage difference Vsg between the power supply voltage VDD and the node NB may be decreased as the resistance value corresponding to the bias generating unit, and a bias voltage Vbias may be increased accordingly. In the present embodiment, the high driving ratio signal HDR may be disabled as the bias voltage Vbias is larger than a threshold voltage, where the threshold voltage may be within a range from a ground reference voltage to the power supply voltage VDD.

As for the case that the switch SW1 is turned off and the switch SW2 is turned on, the transistor M2 may be turned off and only the transistor M1 may be turned on, such that the bias generating unit may correspond to the turned-on resistance of the turned-on transistor M1. Thus, the voltage difference Vsg between the power supply voltage VDD and the node NB may be increased as the resistance value corresponding to the bias generating unit, and the bias voltage Vbias may be decreased accordingly. In the present embodiment, the high driving ratio signal HDR may be enabled as the bias voltage Vbias is not larger than the threshold voltage.

Based on the above, the voltage difference Vsg may be determined by the number of the turned-on transistors in the bias generating circuit, and thereby the bias voltage Vbias may be adjusted, so as to disable or enable the high driving ratio signal HDR.

It is worth mentioning that, the number of the transistors in the bias generating unit may be adaptively adjusted, such as three or more. Correspondingly, there may be a multiplexer included in the adjusting circuit 330 for converting the control signal TP into multiple signals to switch the transistors on or off. The invention is not intended to limit thereto.

Referring back to FIG. 3A. In the driving apparatus 300, the DAC 340 may be coupled to the output buffer 310. The DAC 340 may receive an input code CI, and may execute a digital-to-analog operation to convert the input code CI into the input voltage VI, where the input code CI may be in a digital format and the input voltage VI may be in an analog format.

The code detecting unit 350 may be coupled to the DAC 340 and the adjusting circuit 330. The code detecting unit 350 may be used for detecting the input code CI and determining whether the input code CI varies or changes based on the detecting result.

In detail, the code detecting unit 350 may include at least one register (merely a register 352 is illustrated in FIG. 3A for convenient description) and a logic operator 354 (e.g. a comparator). The code detecting unit 350 may hold a previous input code through the register 352, and may compare the previous input code and a current input code to generate a comparing result by the logic operator 354. Then, the logic operator 354 may provide the comparing result for the adjusting circuit 330. For instance, when the previous input code and the current input code are different, the logic operator 354 may provide the comparing result with a high voltage level to the adjusting circuit 330, such that the adjusting circuit 330 may adjust the high driving ratio signal HDR. On the other hand, when the previous input code and the current input code are the same, the logic operator 354 may provide the comparing result with a low voltage level to the adjusting circuit 330, such that the adjusting circuit 330 may not adjust the high driving ratio signal HDR.

In the following exemplary embodiments, a method for driving a display panel (corresponding to the load 400) is provided. However, type of the load 400 may be adjusted based on design requirements, and the invention is not intended to limit thereto.

Figure 4:
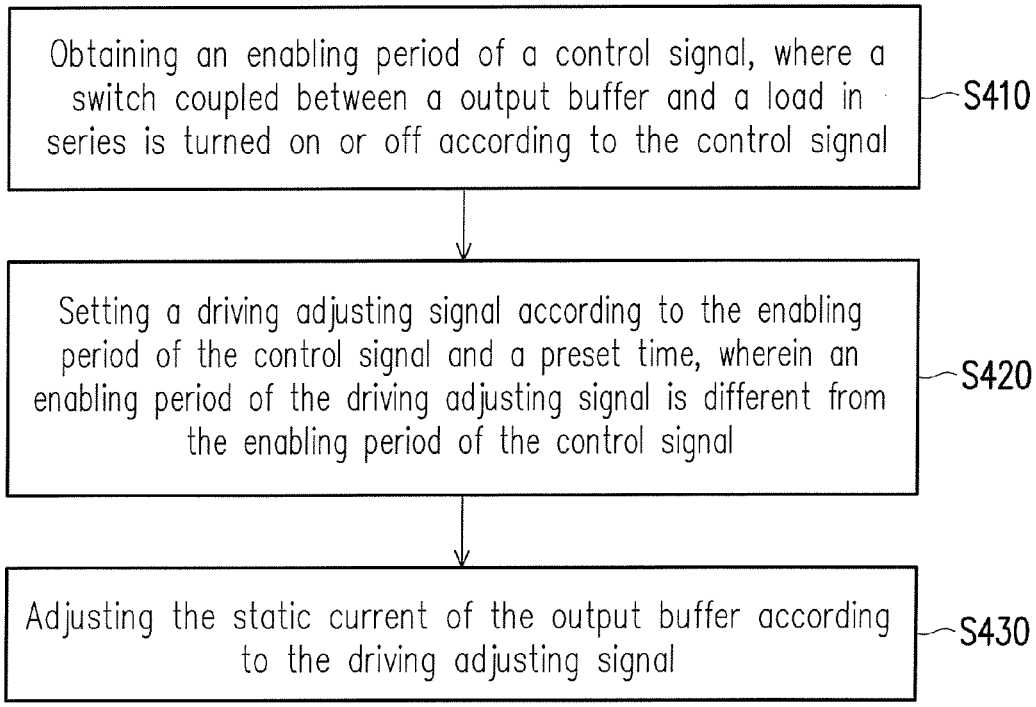
FIG. 4 is a flow chart illustrating a method for driving a display panel according to an embodiment of the invention.

FIG. 4 is a flow chart illustrating a method for driving a display panel according to an embodiment of the invention, which is adapted to the driving apparatus 300 in FIG. 3A. Detailed steps of the proposed method will be illustrated along with the components of the driving apparatus 300 hereafter.

Referring to FIG. 3A and FIG. 4, in Step S410, the adjusting circuit 330 obtains an enabling period EPT of a control signal TP, where the switch 320 coupled between the output buffer 310 and the load 400 in series is turned on or off according to the control signal TP. As described above, in the present embodiment, during the enabling period EPT of the control signal TP, the switch 320 may be turned off, which may correspond to a duration of the digital-to-analog conversion executed by the DAC 340. In addition, the enabling period EPT of the control signal TP may be a setting value, which may depend on specifications or requirements of designers.

In Step S420, the adjusting circuit 330 sets a high driving ratio signal HDR according to the enabling period EPT of the control signal TP and a preset time. Specifically, an enabling period of the high driving ratio signal HDR is different from the enabling period EPT of the control signal TP. Then, in Step S430, the adjusting circuit 330 adjusts the static current of the output buffer 310 according to the high driving ratio signal HDR.

In detail, the preset time may be determined according to the speed of the output voltage VO reaching the target voltage. In other words, the adjusting circuit 330 may compare the enabling period EPT of the control signal TP with the preset time, so as to determine whether the enabling period EPT of the control signal TP is longer enough for the output voltage VO reaching the target voltage. If the enabling period EPT of the control signal TP is longer than the preset time, it may be indicated that the output voltage VO may reach to the target voltage during the enabling period EPT and before the control signal TP is disabled.

On the other hand, if the enabling period EPT of the control signal TP is not longer than the preset time, it may be indicated that the static current of the output buffer 310 may be needed to increase for ensuring the output voltage VO may reach to the target voltage during the enabling period EPT of the control signal TP.

Hence, based on the comparing result of the enabling period EPT of the control signal TP and the preset time, the adjusting circuit 330 may adjust the static current of the output buffer 310 by setting the high driving ratio signal HDR, such that the static current of the output buffer 310 may be effectively controlled, and therefore the power consumption issue during the enabling period EPT of the control signal TP may be reduced.

The static current of the output buffer 310 may be adjusted depending on an enabling period of the high driving ratio signal HDR, a current driving ratio for setting the static current of the output buffer 310 when the high driving ratio signal HDR is enabled, and situations whether the input code CI varies when the DAC 340 executes the digital-to-analog operation. The following embodiments in FIG. 5 to FIG. 7 and FIG. 9 may respectively illustrate timing control of the control signal TP and the high driving ratio signal HDR in detail.

First, in an embodiment, the adjusting circuit 330 may sets the enabling period of the high driving ratio signal HDR according to the comparison of the enabling period EPT of the control signal TP and the preset time.

More specifically, the adjusting circuit 330 may determine whether the enabling period EPT of the control signal TP is longer than the preset time. When the enabling period EPT of the control signal TP is longer than the preset time, the adjusting circuit 330 may decrease the enabling period of the high driving ratio signal HDR than the enabling period EPT of the control signal TP, and when the enabling period EPT of the control signal TP is not longer than the preset time, the adjusting circuit 330 may increase the enabling period of the high driving ratio signal HDR than the enabling period EPT of the control signal TP.

Figure 5:
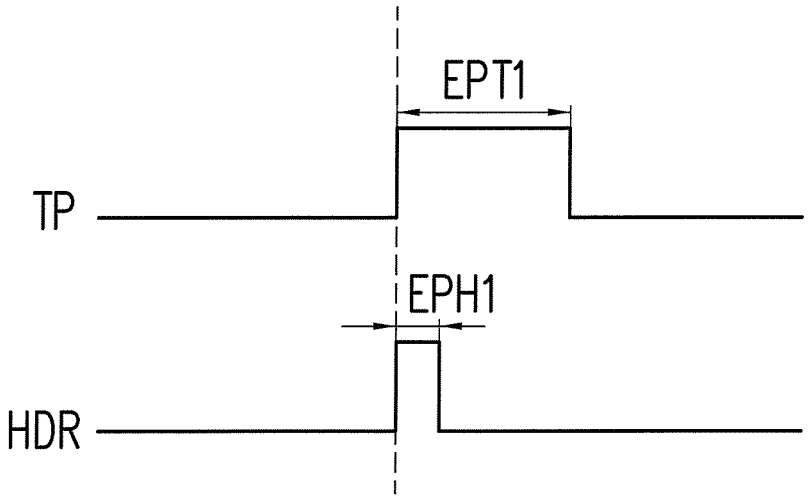
FIG. 5 is a timing diagram of signals in the method for driving a display panel according to the embodiment of FIG. 4.
Figure 6:
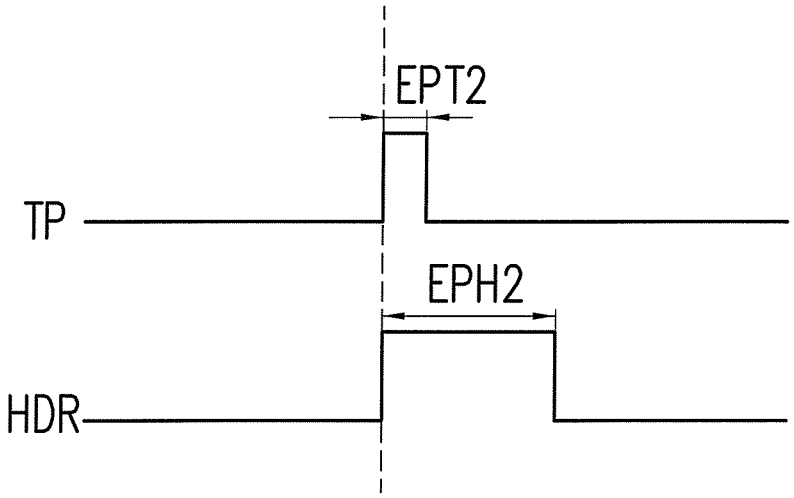
FIG. 6 is another timing diagram of signals in the method for driving a display panel according to the embodiment of FIG. 4.

FIG. 5 is a timing diagram of signals in the method for driving a display panel according to the embodiment of FIG. 4, and FIG. 6 is another timing diagram of signals in the method for driving a display panel according to the embodiment of FIG. 4, which may respectively disclose the aforementioned situation.

Referring to FIG. 5, when the adjusting circuit 330 obtains an enabling period EPT1 of the control signal TP and determines that the enabling period EPT1 of the control signal TP is longer than the preset time, the adjusting circuit 330 may set an enabling period EPH1 of the high driving ratio signal HDR to be shorter than the enabling period EPT1 of the control signal TP. Thus, the static current of the output buffer 310 during the enabling period EPT1 of the control signal TP may be reduced.

On the other hand, referring to FIG. 6, when the adjusting circuit 330 obtains an enabling period EPT2 of the control signal TP, and determines that the enabling period EPT2 of the control signal TP is not longer than the preset time, the adjusting circuit 330 may set an enabling period EPH2 of the high driving ratio signal HDR to be longer than the enabling period EPT2 of the control signal TP. Since the enabling period EPH2 of the high driving ratio signal HDR may be longer enough, the output voltage VO may be ensured to reach the target voltage.

It is worth mentioning that, in the embodiments of FIG. 5 and FIG. 6, enabling time points of the control signal TP and the high driving ratio signal HDR may be the same. In other words, the adjusting circuit 330 may enable the high driving ratio signal HDR and the control signal TP at the same time, while disable the high driving ratio signal HDR and the control signal TP at different times.

Secondly, in another embodiment, the adjusting circuit 330 may adjust a current driving ratio for setting the static current of the output buffer 310 when the high driving ratio signal HDR is enabled according to the comparison of the enabling period EPT of the control signal TP and the preset time.

It should be noted that the current driving ratio may be used for determining increasing amount of the static current during the enabling period EPT of the control signal TP. For instance, by providing the static current through a plurality of current sources, the adjusting circuit 330 may control a number of the current sources to be connected to the output buffer 310 by the setting current driving ratio, such that the number of current sources connected to the output buffer 310 may determine current value of the static current.

In the present embodiment, the adjusting circuit 330 may determine whether the enabling period EPT of the control signal TP is longer than the preset time. When the enabling period EPT of the control signal TP is longer than the preset time, the adjusting circuit 330 may decrease the current driving ratio (e.g. doubling), and when the enabling period EPT of the control signal TP is not longer than the preset time, the adjusting circuit 330 may increase the current driving ratio (e.g. increasing by at least three times). In other words, the present embodiment may determine the static current and the driving ability of the output buffer 310 by changing the current driving ratio.

Thirdly, in another embodiment, the adjusting circuit 330 may disable the high driving ratio signal HDR when the input code CI varies. If a frame is hold and unchanged, the input code CI may not vary, and hence the high driving ratio signal HDR may not be necessary to be enabled. Otherwise, if the frame is changed, the input code CI may vary, and the high driving ratio signal HDR may be enabled.

As mentioned in the aforementioned embodiment, the code detecting unit 350 may detect the input code CI, particularly including the current input code and the previous input code, and may compare the current input code and the previous input code to generate the comparing result and then provide the comparing result for the adjusting circuit 330. The adjusting circuit 330 may determine whether the input code CI varies when the control signal TP is enabled based on the comparing result. When the input code CI does not vary when the control signal is enabled, the adjusting circuit 330 may disable the high driving ratio signal HDR, which may avoid to generate unnecessary static current during the enable period EPT of the control signal TP.

Figure 7:
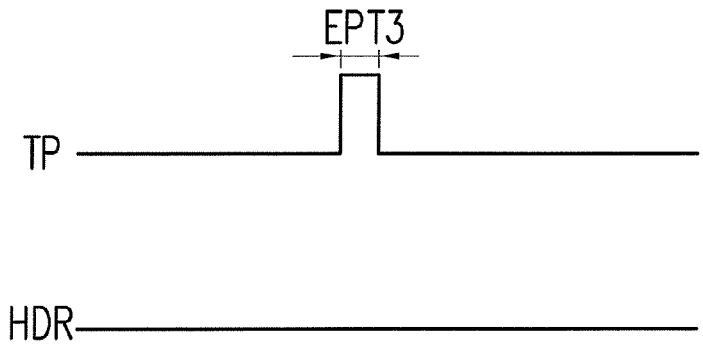
FIG. 7 is another timing diagram of signals in the method for driving a display panel according to the embodiment of FIG. 4.

FIG. 7 is another timing diagram of signals in the method for driving a display panel according to the embodiment of FIG. 4. Referring to FIG. 7, when the adjusting circuit 330 determines that the input code CI does not vary when the control signal TP is enabled, the adjusting circuit 330 may disable the high driving ratio signal HDR, such as holding the high driving ratio signal HDR as a low voltage level, particularly during the enabling period EPT3 of the control signal TP.

Figure 8:
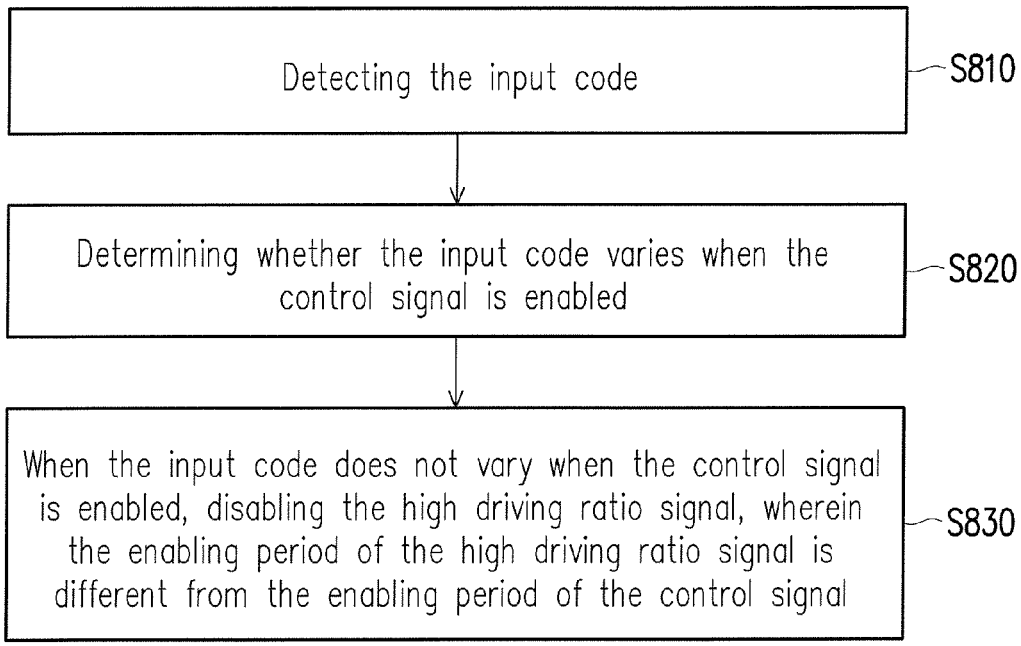
FIG. 8 is a flow chart illustrating a method for driving a display panel according to an embodiment of the invention.

From another perspective, the present embodiment may provide a plurality of detailed steps for driving the display panel. FIG. 8 is a flow chart illustrating a method for driving a display panel according to an embodiment of the invention, which may be adapted to the driving apparatus 300 in FIG. 3A. Referring to FIG. 8, in step S810, the code detecting unit 350 detects the input code CI. In step S820, the adjusting circuit 330 determines whether the input code CI varies when the control signal TP is enabled. When the input code CI does not vary when the control signal TP is enabled, in Step S830, the adjusting circuit 330 disables the high driving ratio signal HDR, wherein the enabling period of the high driving ratio signal HDR is different from the enabling period of the control signal TP.

Fourthly, in another embodiment, both the enabling period EPT of the control signal TP and change of the input code CI are considered. More specifically, the adjusting circuit 330 may determine whether the enabling period EPT of the control signal TP is shorter than the preset time, and determine whether the input code CI varies when the control signal TP is enabled. When the enabling period EPT of the control signal TP is shorter than the preset time, and when the input code CI varies when the control signal TP is enabled, the adjusting circuit 330 may obtain a gray-scale difference according to the varied input code CI, and increase the enabling period EPH of the high driving ratio signal HDR according to the gray-scale difference.

Figure 9:
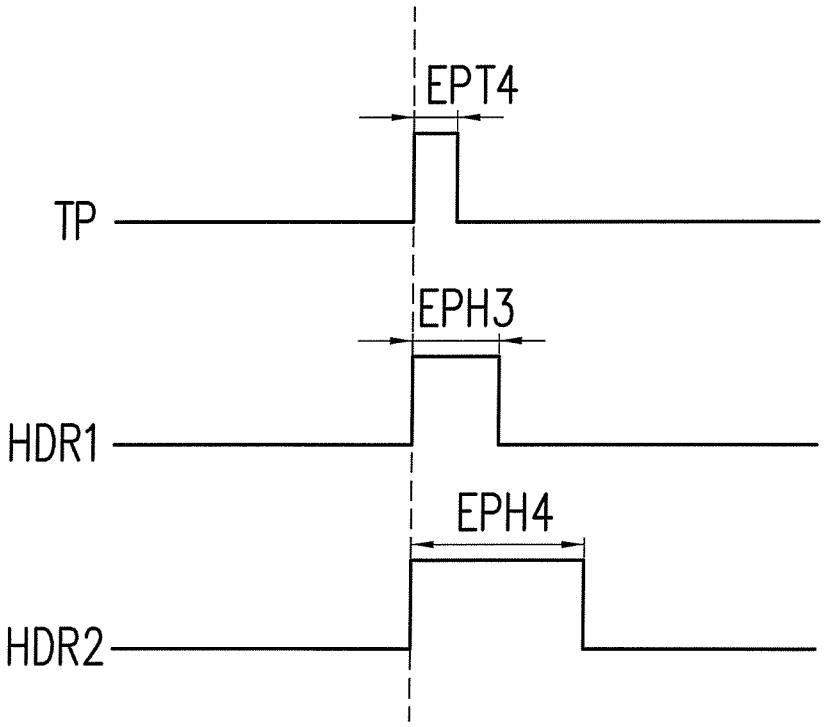
FIG. 9 is another timing diagram of signals in the method for driving a display panel according to the embodiment of FIG. 4.

Take 8-bit gray scale For instance, FIG. 9 is another timing diagram of signals in the method for driving a display panel according to the embodiment of FIG. 4. Referring to FIG. 9, in the present embodiment, the adjusting circuit 330 determines that the enabling period EPT4 of the control signal TP is shorter than the preset time. Further, the adjusting circuit 330 may determine that the gray-scale difference caused by the input code CI varying is 64 levels. Therefore, the adjusting circuit 330 may increase the enabling period EPH3 of the high driving ratio signal HDR1 as, for example, two times of the enabling period EPT4 of the control signal TP. Besides, as for the gray-scale difference caused by the input code CI varying is 128 levels, the adjusting circuit 330 may increase the enabling period EPH4 of the high driving ratio signal HDR2 as, for example, three times of the enabling period EPT4 of the control signal TP.

It should be noted that, in the embodiment of FIG. 9, the adjusting circuit 330 may increase the enabling period EPH3 of the high driving ratio signal HDR1 by delay disable time point of the high driving ratio signal HDR1, and may increase the enabling period EPH4 of the high driving ratio signal HDR2 by delay disable time point of the high driving ratio signal HDR2. In particular, more levels of the gray-scale difference caused by the input code varying, more static current may be required to pull the output voltage VO to reach the target voltage. Therefore, the adjusting circuit 330 may adjust the enabling period EPH4 of the high driving ratio signal HDR2 longer than the enabling period EPH3 of the high driving ratio signal HDR1, so as to ensure the output voltage VO of the output buffer 310 is correct and consistent with the input code CI.

It is worth mentioning that, in the aforementioned embodiments, since the static current of the output buffer 310 may be reduced, temperature of the driving apparatus 300 may be also decreased, which may extend lifetime of the driving apparatus 300 accordingly.

To conclude the above, the embodiments disclosed by the invention may adaptively adjust the enabling period of the high driving ratio signal to be different from the enabling period of the control signal, particularly according to the enabling period of the control signal and the preset time. In addition, the current driving ratio for setting the static current of the output buffer may also be adjusted when the high driving ratio signal is enabled. Besides, when the input code does not vary when the control signal is enabled, the high driving ratio signal may be disabled. The case for the gray-scale difference of the input code may also be considered. Therefore, the static current of the output buffer may be adaptively adjusted according to the high driving ratio signal, and thus the power consumption caused by the static current may be effectively reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving apparatus, adapted to drive a display panel, comprising:

an output buffer, receiving an input voltage, and providing an output voltage to a load according to a static current, wherein the static current determines a speed of the output voltage reaching a target voltage for driving the load;

a switch, coupled between the output buffer and the load in series, wherein the switch is turned on or off according to a control signal;

an adjusting circuit, coupled to the output buffer;

a digital-to-analog converter, coupled to the output buffer, receiving an input code, and converting the input code into the input voltage; and a code detecting unit, coupled to the digital-to-analog converter and the adjusting circuit, detecting the input code, wherein the adjusting circuit determines whether the input code varies when the control signal is enabled, and when the input code does not vary when the control signal is enabled, the adjusting circuit disables a high driving ratio signal, wherein an enabling period of the high driving ratio signal is different from an enabling period of the control signal.

2. The driving apparatus according to claim 1, wherein the adjusting circuit obtains the enabling period of the control signal, sets the high driving ratio signal according to the enabling period of the control signal and a preset time, and adjusts the static current of the output buffer according to the high driving ratio signal.

3. The driving apparatus according to claim 2, wherein the preset time is determined according to the speed of the output voltage reaching the target voltage.

4. The driving apparatus according to claim 2, wherein the adjusting circuit sets the enabling period of the high driving ratio signal according to a comparison of the enabling period of the control signal and the preset time.

5. The driving apparatus according to claim 4, wherein the adjusting circuit determines whether the enabling period of the control signal is longer than the preset time, when the enabling period of the control signal is longer than the preset time, the adjusting circuit decreases the enabling period of the high driving ratio signal than the enabling period of the control signal, and when the enabling period of the control signal is not longer than the preset time, the adjusting circuit increases the enabling period of the high driving ratio signal than the enabling period of the control signal.

6. The driving apparatus according to claim 2, wherein the adjusting circuit adjusts a current driving ratio for setting the static current of the output buffer when the high driving ratio signal is enabled according to a comparison of the enabling period of the control signal and the preset time.

7. The driving apparatus according to claim 6, wherein the adjusting circuit determines whether the enabling period of the control signal is longer than the preset time, when the enabling period of the control signal is longer than the preset time, the adjusting circuit decreases the current driving ratio, and when the enabling period of the control signal is not longer than the preset time, the adjusting circuit increases the current driving ratio.

8. The driving apparatus according to claim 2, wherein when the enabling period of the control signal is shorter than the preset time, and when the input code varies when the control signal is enabled, the adjusting circuit obtains a gray-scale difference according to the varied input code, and increases the enabling period of the high driving ratio signal according to the gray-scale difference.

9. The driving apparatus according to claim 1, wherein an enable time point of the control signal and an enable time point of the high driving ratio signal are the same.

10. The driving apparatus according to claim 1, wherein the output buffer is an operational amplifier, and the adjusting circuit comprising:

a bias generating unit, comprising a plurality of transistors coupled in parallel between a power supply voltage and a current source; and a switching circuit, coupled to the bias generating unit, turning on at least one of the transistors according to the enabling period of the control signal, wherein the bias generating unit generates a bias voltage to disable or enable the high driving ratio signal according to a number of the turned-on transistors.

11. A method for driving a display panel, adapted to a driving apparatus comprising an output buffer, a switch, a digital-to-analog converter and a code detecting unit, the output buffer receiving an input voltage and providing an output voltage to a load according to a static current, wherein the static current determines a speed of the output voltage reaching a target voltage for driving the load, the digital-to-analog converter receives an input code and converts the input code into the input voltage, and the method for driving the display panel comprising:

detecting the input code by the code detecting unit;

determining whether the input code varies when a control signal is enabled, wherein the switch coupled between the output buffer and the load in series is turned on or off according to the control signal; and when the input code does not vary when the control signal is enabled, disabling a high driving ratio signal, wherein an enabling period of the high driving ratio signal is different from an enabling period of the control signal.

12. The method for driving a display panel according to claim 11, wherein the method for driving the display panel further comprising:

obtaining the enabling period of the control signal;

setting the high driving ratio signal according to the enabling period of the control signal and a preset time; and adjusting the static current of the output buffer according to the high driving ratio signal.

13. The method for driving a display panel according to claim 12, wherein the preset time is determined according to the speed of the output voltage reaching the target voltage.

14. The method for driving a display panel according to claim 12, wherein the step of setting the high driving ratio signal according to the enabling period of the control signal and the preset time comprising:

setting the enabling period of the high driving ratio signal according to a comparison of the enabling period of the control signal and the preset time.

15. The method for driving a display panel according to claim 14, wherein the step of setting the enabling period of the high driving ratio signal according to the comparison of the enabling period of the control signal and the preset time comprising:

determining whether the enabling period of the control signal is longer than the preset time;

when the enabling period of the control signal is longer than the preset time, decreasing the enabling period of the high driving ratio signal than the enabling period of the control signal; and when the enabling period of the control signal is not longer than the preset time, increasing the enabling period of the high driving ratio signal than the enabling period of the control signal.

16. The method for driving a display panel according to claim 12, wherein the step of setting the high driving ratio signal according to the enabling period of the control signal and the preset time comprising:

adjusting a current driving ratio for setting the static current of the output buffer when the high driving ratio signal is enabled according to a comparison of the enabling period of the control signal and the preset time.

17. The method for driving a display panel according to claim 16, wherein the step of adjusting the current driving ratio for setting the static current of the output buffer when the high driving ratio signal is enabled according to the comparison of the enabling period of the control signal and the preset time comprising:

determining whether the enabling period of the control signal is longer than the preset time;

when the enabling period of the control signal is longer than the preset time, decreasing the current driving ratio; and when the enabling period of the control signal is not longer than the preset time, increasing the current driving ratio.

18. The method for driving a display panel according to claim 12, further comprising:

when the enabling period of the control signal is shorter than the preset time, and when the input code varies when the control signal is enabled, obtaining a gray-scale difference according to the varied input code, and increasing the enabling period of the high driving ratio signal according to the gray-scale difference.

19. The method for driving a display panel according to claim 11, wherein an enable time point of the control signal and an enable time point of the high driving ratio signal are the same.

20. The method for driving a display panel according to claim 11, wherein the output buffer is an operational amplifier, and the step of setting a high driving ratio signal according to the enabling period of the control signal and a preset time comprising:

turning on at least one of a plurality of transistors according to the enabling period of the control signal; and generating a bias voltage to disable or enable the high driving ratio signal according to a number of the turned-on transistors.

* * * * *